US005427296A

United States Patent [19]

Chen

[11] Patent Number: 5,427,296

[45] Date of Patent: Jun. 27, 1995

[54] POWER STAPLER

[76] Inventor: Bruce Chen, 1F., No. 17, Alley 18, Chiung En Lane, Chiung Lin Road, Hsinchuan City, Taipei Hsien, Taiwan

[21] Appl. No.: 326,932

[22] Filed: Oct. 21, 1994

[51] Int. Cl.[6] ..... B25C 1/06; B27F 7/36

[52] U.S. Cl. ..... 227/7; 227/131

[58] Field of Search ..... 227/7, 120, 131

[56] References Cited

U.S. PATENT DOCUMENTS

| | | | |
|---|---|---|---|
| 4,542,844 | 9/1985 | Olesen et al. | 227/7 |
| 4,589,581 | 5/1986 | Balma | 227/7 |
| 4,623,082 | 11/1986 | Kurosawa | 227/131 |
| 4,726,505 | 2/1988 | Okazaki | 227/131 |
| 5,007,572 | 4/1991 | Chung-Cheng | 227/131 |
| 5,330,086 | 7/1994 | Shimomura et al. | 227/7 |

*Primary Examiner*—Scott A. Smith

*Attorney, Agent, or Firm*—Varndell Legal Group

[57] ABSTRACT

A power stapler including a cover shell, a base, a frame, a circuit board assembly, an electromagnetic valve, a magazine and tie plate assembly, an anvil, a micro-switch, a presser case assembly, a staple magazine constraint control device, an adjusting rod, and a linkage, wherein the valve block of the electromagnetic valve is controlled by the circuit board to drive the linkage causing the presser case assembly reciprocated to achieve a striking in driving a staple through the sheets of paper to be fastened; the adjusting rod is turned to move the circuit board assembly in changing the position of the micro-switch so that the binding position is adjusted.

1 Claim, 7 Drawing Sheets

POWER STAPLER

BACKGROUND AND SUMMARY OF THE INVENTION

The present invention relates to staplers, and more particularly to a power stapler for bookbinding.

FIG. 1 shows a power stapler according to the prior art which comprises a motor, a transmission gear coupled to the motor, a driven gear wheel meshed with the transmission gear and having an eccentric rod, a forked link, a striking plate pulled by a spring and stopped by the forked link, and an anvil. When the motor is turned on, the driven gear wheel is turned by the transmission gear to move the forked link by the eccentric rod thereof, causing the forked front end of the forked link released from the striking plate, and therefore the spring immediately pulls down the striking plate causing a staple driven through the sheets of paper being placed on the anvil. This structure of Dower stapler is not suitable for fastening a thick stack of paper because the striking plate is not forced downward to strike the staple by a high pressure from the top but simply pulled down by the spring. When the striking plate is pulled to driven a staple through a thick stack of paper, the driven gear wheel or its eccentric rod or the transmission gear may be damaged easily. Another drawback of this structure of power stapler is that the binding position is not adjustable. Still another drawback of this strucutre of power stapler is its complicated structure.

The present invention has been accomplished to provide a power stapler which eliminates the aforesaid drawbacks. According to one aspect of the present invention, the power stapler including a cover shell, a base, a frame, a circuit board assembly, an electromagnetic valve, a magazine and time plate assembly, an anvil, a micro-switch, a presser case assembly, a staple magazine constraint control device, an adjusting rod, and a linkage, wherein the valve block of the electromagnetic valve is controlled by the circuit board to drive the linkage causing the presser case assembly reciprocated to achieve a striking in driving a staple through the sheets of paper to be fastened.

According to another aspect of the present invention, the adjsuting rod can be turned in either direction to move the circuit board assembly in changing the position of the micro-switch so that the binding position is adjusted.

According to still another aspect of the present invention, the staple magazine is automatically pushed out of the magazine seat by a spring for loading staples when the link is rotated.

DETAILED DESCRIPTION OF THE PREFERRED EMBODIMENT

Figure 1:
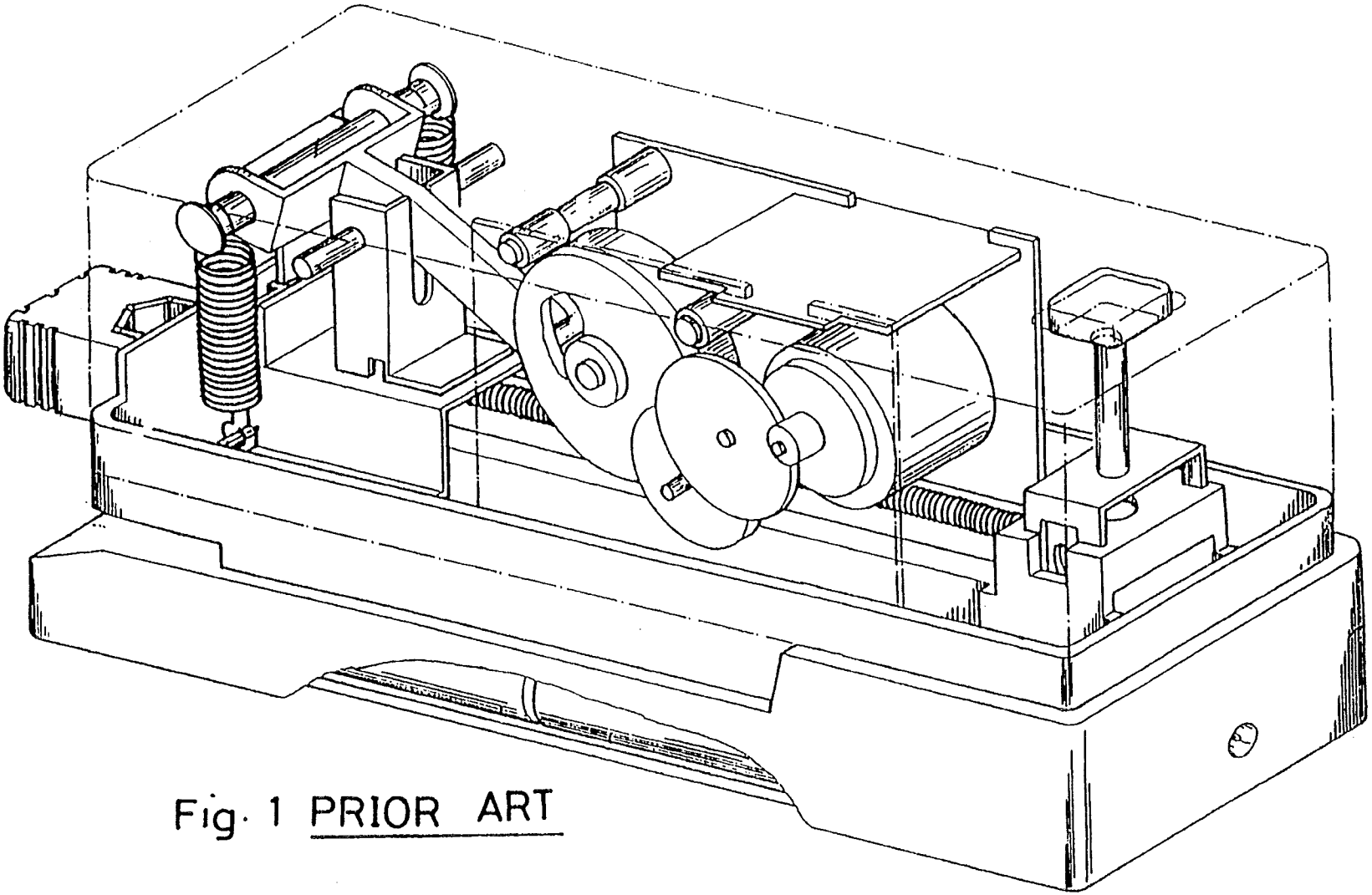
Fig. 1 PRIOR ART
FIG. 1 is a perspective view of a power stapler according to the prior art.
Figure 2:
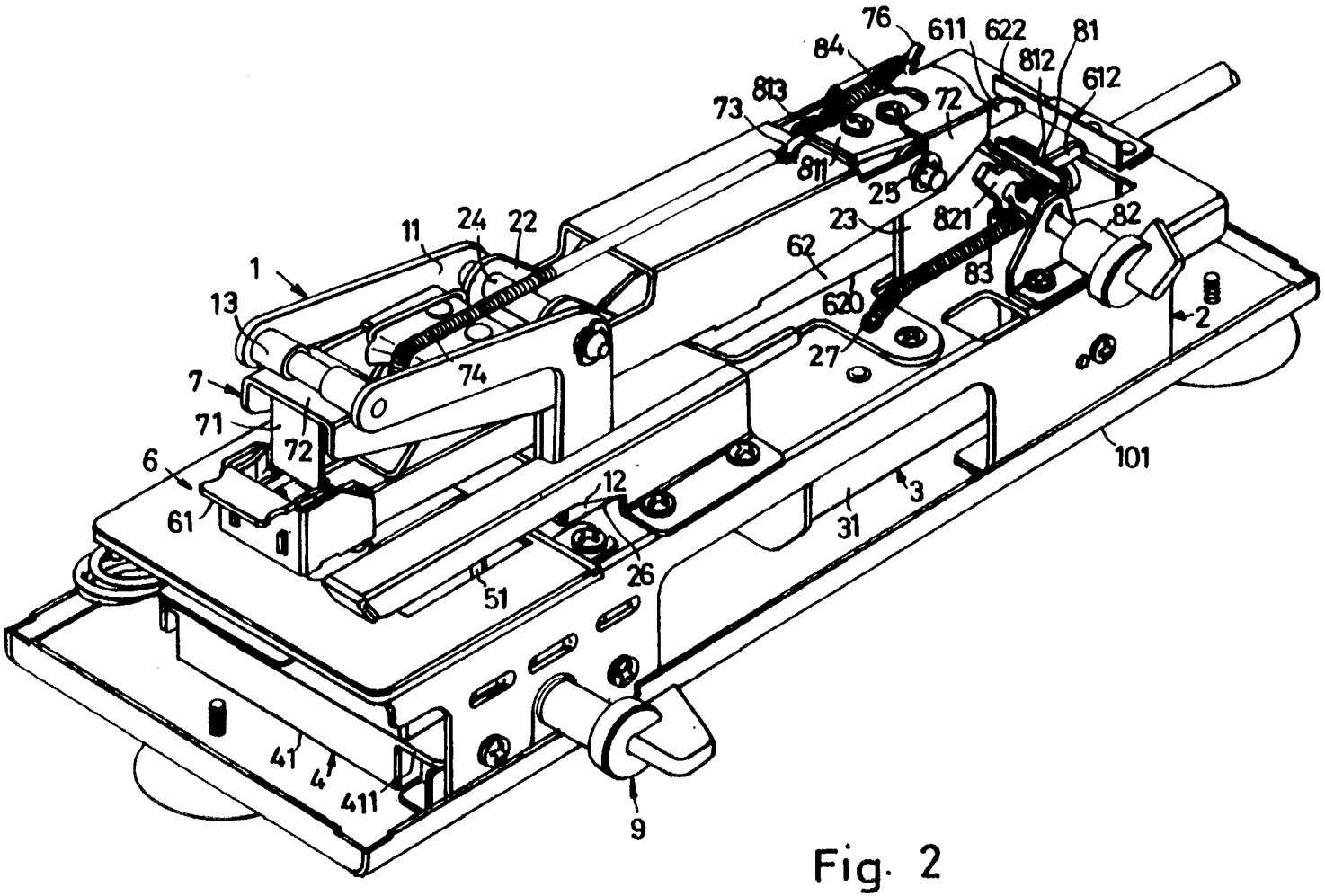
FIG. 2 is an elevational view of a power stapler according to the present invention (the cover shell removed).

Referring to FIGS. 2 through 7, the power stapler of the present invention comprises mainly a cover shell (not shown), a base 101, a frame 2 mounted on the base 101, a circuit board assembly 4 mounted on the frame 2 at the bottom near the front end, an electromagnetic valve 3 mounted on the frame 2 at the bottom near the rear end, a magazine and tie plate assembly 6 mounted on the frame 2 at the top near the front end, an anvil 21 mounted on the frame 2 at the top below the front end of the magazine and tie plate assembly 6, a micro-switch 5 mounted on the circuit board assembly 4 and having a switching lever 51 projecting out of the top surface of the frame 2 for triggering by the sheets of paper 10 to be fastened, a presser case assembly 7 disposed above the magazine and tie plate assembly 6 and operated to move the striking plate 71 thereof into the magazine and tie plate assembly 6 to achieve a binding action, a staple magazine constraint control device 8 for pushing the staple magazine 61 of the magazine and tie plate assembly 6 into the binding position, an adjusting rod 9 for adjusting the position of the circuit board assembly 4, and a linkage 1.

The frame 2 comprises a front support 22, a first pivot axle 24 transversely supported on the front support 22 pivotally coupled with the two opposite middle portions 11 of the linkage 1, a rear support 23, a second pivot axle 25 transversely supported on the rear support 23 and pivotally coupled with the front end 72 of the presser case assembly 7 and the channel plate 811 of the magazine constraint plate 81 of the staple magazine constraint control device 8 and the coupling portion 621 of the magazine seat 62 of the magazine and tie plate assembly 6, a slot 26 for passing the two opposite rear ends 12 of the linkage 1, a hook 27 at the top for fastening one end of the spring 83 of the staple magazine contraint control device 8, and a sliding way 28 at the bottom.

The electromagnetic valve 3 comprises a valve block 31 connected to the two opposite bottom ends 12 of the linkage 1 and controlled by the circuit board assembly 4 to move back and forth. When the valve block 31 is reciprocated, the linkage 1 is oscillated on the first pivot axle 24.

The circuit board assembly 4 comprises a box 41 and a circuit board received inside the box 41. The box 41 has two opposite side rails 411 made to slide in the sliding way 28 (see FIGS. 5 and 6). One of the side rails 411 has a toothed bottom wall 4111 meshed with a driving gear 91 on the adjusting rod 9. Therefore, the position of the circuit board assembly 4 in the sliding way 28 can be changed by turning the adjusting rod 9 in either direction.

The micro-switch 5 is installed in the circuit board of the circuit board assembly 4 with its switching lever 51 extended out of the box 41 and projecting over the frame 2.

Figure 4:
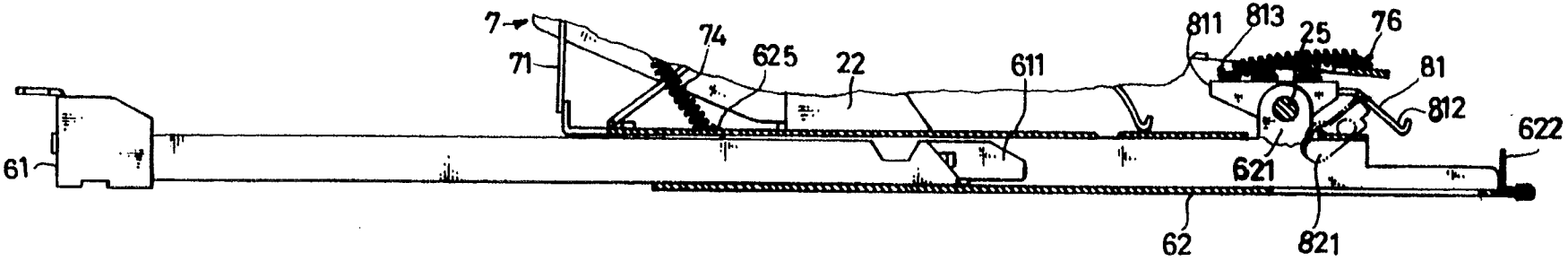
FIG. 4 is a partial view in section of the power stapler shown in FIG. 2, showing the staple magazine extended out of the magazine seat.

The magazine and tie plate assembly 6 comprises a magazine seat 62 having a coupling portion 621 coupled to the channel plate 811 of the magazine stop plate 81 of the staple magazine constraint control device 8 by the second pivot axle 25 on the rear support 23 of the frame 2 and a bottom wall 620 supported on a spring plate 29 above the frame 2 in an oblique position sloping upwards forwards, a spring plate 622 fixed to the rear end of the magazine seat 62, a staple magazine 61 made to slide on the magazine seat 62 and having a rear end 611 stopped at the spring plate 622, a projecting block 612 raised from the rear end 611 of the staple magazine 61 and constrained by the bottom end 812 of the magazine constraint plate 81 of the staple magazine constraint control device 8. As shown in FIG. 4, the projecting block 612 is constrained by the magazine contraint plate 81, therefore the staple magazine 61 is prohibited from being pushed forward by the spring plate 622.

The presser case assembly 7 has a rear end pivotally connected to the second pivot axle 25 and a front end 72 spaced above the magazine and tie plate assembly 6 and linked to the front cross rod 13 of the linkage 1. The presser case assembly 7 further comprises a first hook 73 and a second hook 76 at the top, a spring 74 having one end fastened to the first hook 73 and an opposite end inserted through a hole 75 on the casing of the presser case assembly 7 and connected to a hook 625 on the magazine seat 62 (see FIG. 3).

The staple magazine constraint control device 8 comprises a magazine constraint plate 81, a link 82, and two spirngs 83 and 84. The magazine constraint plate 81 comprises a channel plate 811 at the top pivotally coupled to the coupling portion 621 of the magazine seat 62 by the second pivot axle 25, a bottom end 812 stopped against the projecting block 612 of the staple magazine 61 at the front. The spring 84 has one end fastened to the top end 813 of the magazine constraint plate 81, and an opposite end fastened to the second hook 76 of the presser case assembly 7. The link 82 is coupled to the frame 2 at the back, having a driving plate 821 at the front. By turning the link 82, the magazine constraint plate 81 is moved away from the projecting block 612 of the staple magazine 61 by the driving plate 821, thereby causing the staple magazine 61 pushed forward by the spring plate 622 of the magazine seat 62 (see FIG. 4). The spring 83 has one end connected to the link 82 and an opposite end connected to the frame 2 at a suitable location.

Figure 3:
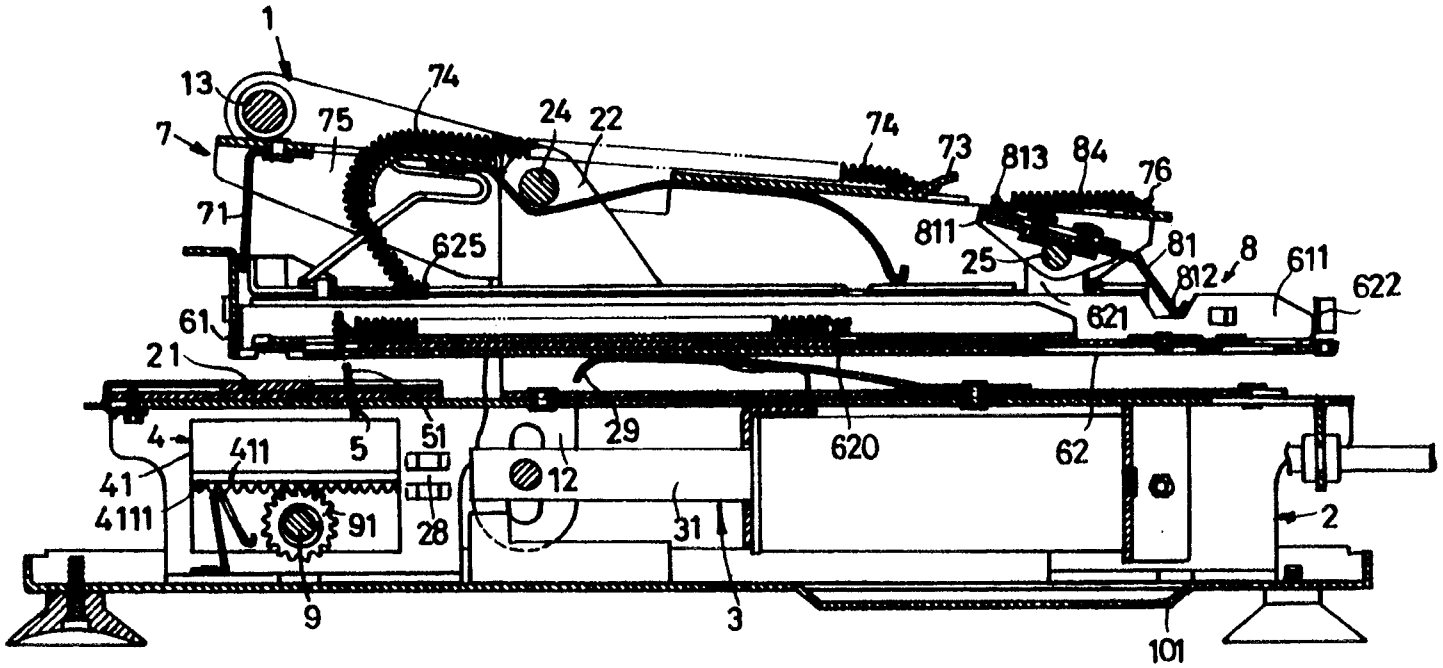
FIG. 3 is a side view in section of the power stapler shown in FIG. 2.
Figure 6:
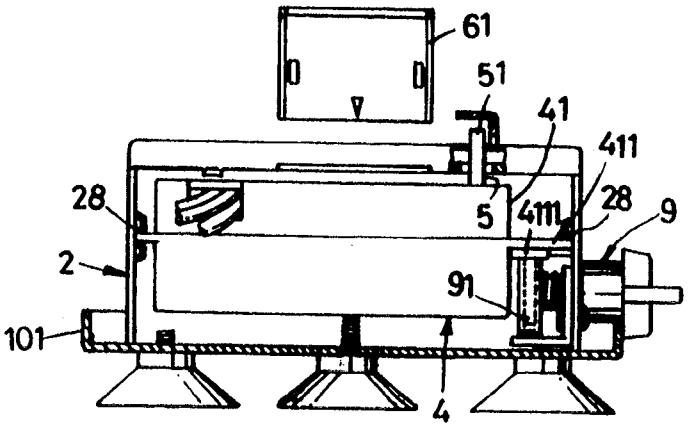
FIG. 6 is a front view in section of the power stapler shown in FIG. 2.

Referring to FIGS. 3 and 6, the adjusting rod 9 is mounted on the frame 2 at the bottom near the front end thereof, having a driving gear 91 meshed with the toothed bottom wall 4111 on one side rail 411 of the box 41 of the circuit board assembly 4. By turning the adjusting rod 91, the box 41 is moved in the sliding way 28, and therefore the position of the switching lever 51 of the micro-switch 5 is adjusted.

Figure 5:
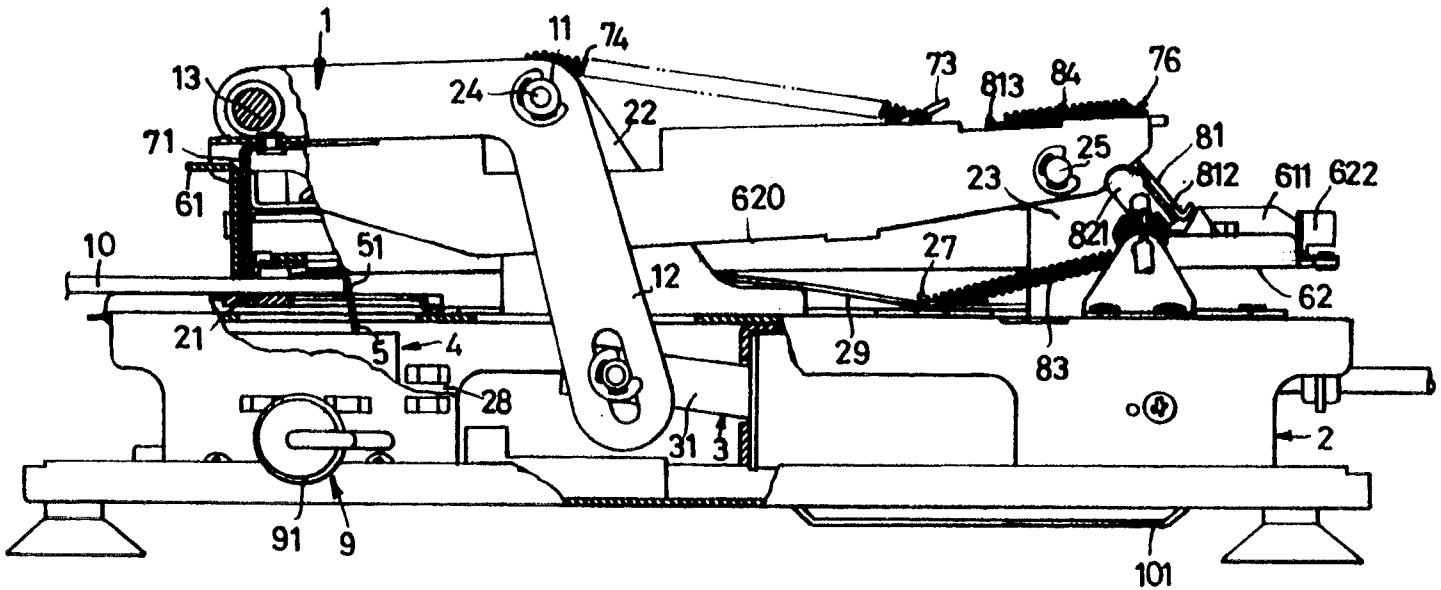
FIG. 5 is similar to FIG. 3 but showing the presser case assembly pressed.

Referring to FIG. 5, the linkage 1 comprises two opposite middle portions 11 pivotally coupled to the two opposite ends of the first pivot axle 24, two opposite rear ends 12 inserted through the slot 26 on the frame 2 and coupled to two opposite sides of the valve block 31 of the electromagnetic valve, a front cross rod 13 linked to the front end 72 of the presser case assembly 7, and a striking plate 71 perpendicularly downwards extended from the front end 72. When the linkage 1 is oscillated to move the front corss rod 13 downwards, the striking plate 71 of the presser case assembly 7 is forced into the staple magazine 61 of the magazine and tie plate assembly 6 causing a staple driven through the sheets of paper 10.

Figure 7:
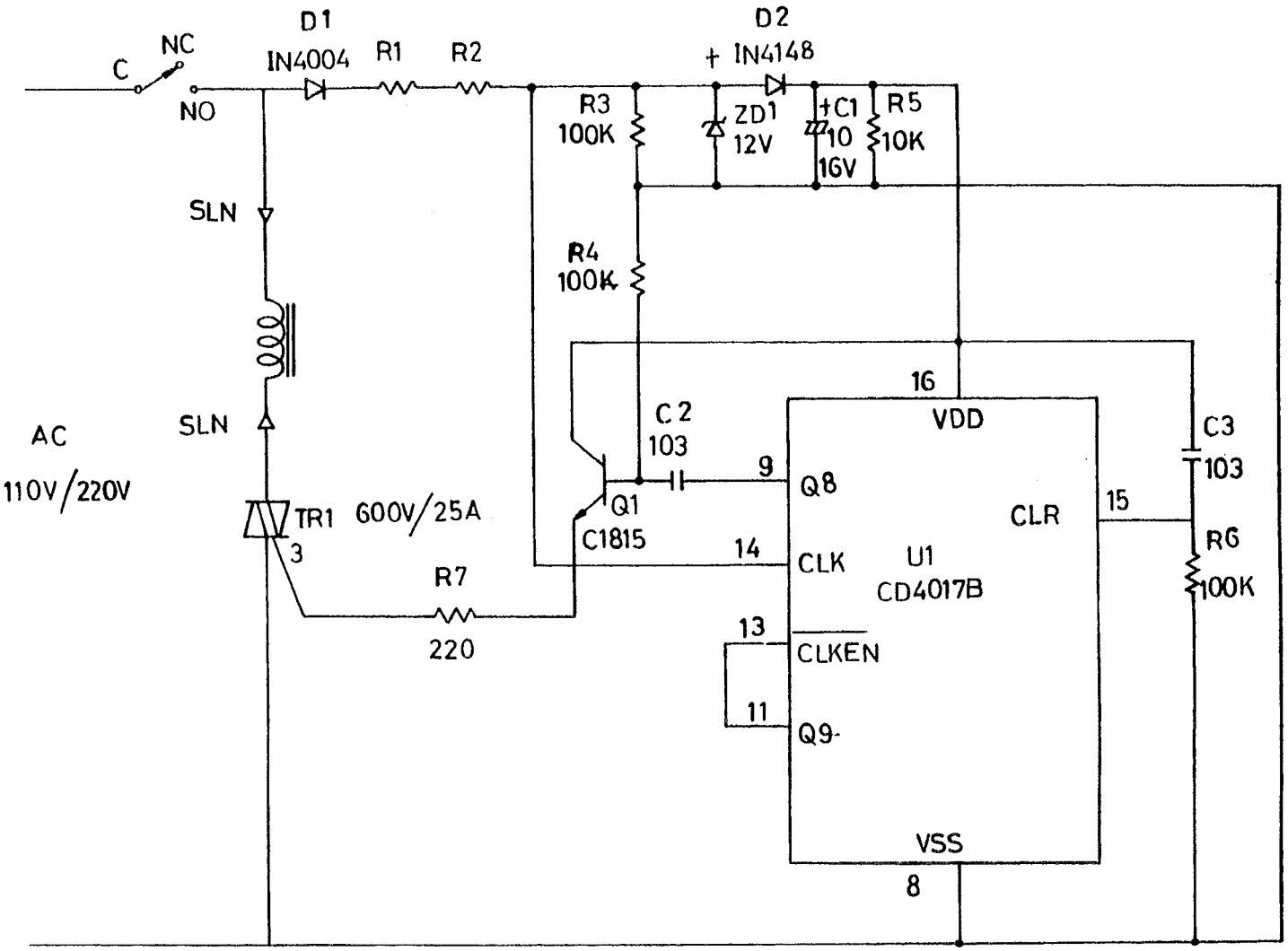
FIG. 7 is a circuit diagram of the circuit board assembly for the power stapler shown in FIG. 2.

Referring to FIG. 7, the circuit board of the circuit board assembly 4 comprises a power switch SW1, a diode D1, two resistors R1 and R2, a central processing unit U1, a transistor Q1, and a diode TR1. When the switching lever 51 of the micro-switch 5 is touched, the power switch SW1 is switched on to let electric current pass. Electric current from the power switch SW1 is filtrated through the diode D1 and then dropped by the resistors R1 and R2 to proivde a working voltage to the central processing unit U1. The central processing unit U1 has one contact pin constantly maintained at HI state. When the power switch SW1 is switched on, the transistor Q1 is turned on causing the diode TR1 to drive the valve block 31 of the electromagnetic valve 3 for one stroke. Upon each triggering, the valve block 31 is reciprocated for one stroke and then immediately returned to the former position for a next stroke upon further triggering.

I claim:

1. A power stapler comprising a cover shell, a base, a frame mounted on said base, a circuit board assembly mounted on said frame at a bottom, an electromagnetic valve mounted on said frame at the bottom behind said circuit board assembly, a magazine and tie plate assembly mounted on said frame at a top, an anvil mounted on said frame at the top, a micro-switch installed in said circuit board assembly, a presser case assembly disposed above said magazine and tie plate assembly and operated to move a striking plate thereof into said magazine and tie plate assembly to achieve a binding action, a staple magazine constraint control device, an adjusting rod for adjusting the position of said circuit board assembly, and a linkage, wherein:

said frame comprises a front support, a first pivot axle transversely supported on said front support, a rear support, a second pivot axle transversely supported on said rear support, a slot, a hook at the top, and a sliding way at the bottom;

said electromagnetic valve comprises a valve block connected to said linkage and controlled by said circuit board assembly to move back and forth;

said circuit board assembly comprises a box, said circuit board received inside said box, said box having two opposite side rails made to slide in said sliding way of said frame, one side rail of said circuit board assembly having a toothed bottom wall;

said micro-switch is installed in said circuit board, Having a switching lever extended out of said box and projecting over said frame;

said magazine and tie plate assembly comprises a magazine seat having a coupling portion coupled to said staple magazine constraint control device by said second pivot axle and a bottom wall supported in an oblique position sloping upwards forwards above said frame by a supporting plate spring, a spring plate fixed to said magazine seat at a back, a staple magazine made to slide on said magazine seat and having a rear end stopped at said spring plate, a protecting block raised from said staple magazine at the back and constrained by said staple magazine constraint control device;

said presser case assembly has a rear end pivotally connected to said second pivot axle and a front end spaced above said magazine and tie plate assembly and kinked to said linkage, comprising a frist hook and a second hook at a top, and a spring having one end fastened to said first hook and an opposite end inserted through a hole on said presser case assembly and connected to a hook on said magazine seat;

said staple magazine constraint control device comprises a magazine constraint plate, a link, a first spring, and a second spring, said magazine constraint plate comprising a channel plate at a top pivotally coupled to the coupling portion of said magazine seat by said second pivot axle, a bottom end stopped against said projecting block of said staple magazine , the first spring of said staple magazine constraint control device having one end connected to said link and an opposite end connected to said frame, the second spring of said staple magazine constraint control device having one end fastened to a top end of said magazine constraint plate and an opposite end fastened to the second hook of said presser case assembly, the link of said staple magazine constraint control device being coupled to said frame at a back and having a driving plate at a front end thereof;

said adjusting rod is mounted on said frame at the bottom, having a driving gear meshed with the toothed bottom wall on one side rail of said box of said circuit board assembly, said gear being turned by said adjusting rod to move said box of said circuit board assembly in said sliding way in changing the position of said switching lever of said microswitch;

said linkage comprises two opposite middle portions pivotally coupled to two opposite ends of said first pivot axle, two opposite rear ends inserted through the slot on said frame and coupled to two opposite ends of said valve block, a front cross rod linked to the front end of said presser case assembly, and a striking plate extending perpendicularly downwards from a front end thereof, said striking plate being forced into said staple magazine to drive a staple through a sheets of paper to be fastened, said linkage is oscillated to move said front cross rod downwards.

* * * * *